US006926096B2

(12) United States Patent
Kash

(10) Patent No.: US 6,926,096 B2
(45) **Date of Patent: *Aug. 9, 2005**

(54) METHOD FOR USING A WELL PERFORATING GUN

(76) Inventor: Edward Cannoy Kash, 11660 Brittmore Park Dr., Houston, TX (US) 77041

( * ) Notice: Subject to any disclaimer, the term of this patent is extended or adjusted under 35 U.S.C. 154(b) by 134 days.

This patent is subject to a terminal disclaimer.

(21) Appl. No.: 10/612,207

(22) Filed: Jul. 1, 2003

(65) Prior Publication Data

US 2004/0211565 A1 Oct. 28, 2004

Related U.S. Application Data

(63) Continuation-in-part of application No. 10/370,142, filed on Feb. 18, 2003, now Pat. No. 6,865,978.

(51) Int. Cl.[7] ..... E21B 43/116

(52) U.S. Cl. ..... 175/2; 166/297; 166/299; 166/308.1; 89/1.15; 102/312; 102/313; 102/331

(58) Field of Search ..... 166/297, 299, 166/308.1, 55, 55.1; 175/2; 102/311, 312, 313, 331; 89/1.15

(56) References Cited

U.S. PATENT DOCUMENTS

| | | | | |
|---|---|---|---|---|
| 2,649,046 A | | 8/1953 | Davis | 102/310 |
| 2,750,885 A | | 6/1956 | Schlumberger | 175/4.6 |
| 2,980,017 A | | 4/1961 | Castel | 175/4.6 |
| 5,775,426 A | | 7/1998 | Snider | 166/308.1 |
| 5,960,894 A | | 10/1999 | Lilly | 175/4.6 |
| 6,336,506 B2 | | 1/2002 | Wesson | 166/308.1 |
| 6,520,258 B1 | | 2/2003 | Yang | 166/297 |
| 6,554,081 B1 | * | 4/2003 | Brooks et al. | 175/4.54 |
| 6,679,327 B2 | | 1/2004 | Sloan | 166/297 |
| 6,732,798 B2 | * | 5/2004 | Johnson et al. | 166/297 |
| 2002/0134585 A1 | | 9/2002 | Walker | 175/4.51 |

* cited by examiner

*Primary Examiner*—David Bagnell
*Assistant Examiner*—Shane Bomar
(74) *Attorney, Agent, or Firm*—Buskop Law Group, P.C.; Wendy Buskop

(57) ABSTRACT

The invention relates to a method to use a perforating gun in oil and natural gas wells, comprising: a perforating gun with a loading tube and explosive charge; the gun comprises: a first layer disposed over the loading tube and at least one outer layer in engagement over the first layer; the outer layer is a solid structure with scallop openings disposed therein and the scallops are in the solid structure in a defined pattern; wherein the method comprises: suspending the gun with a loading tube and explosive charge in a well bore wherein the gun has a longitudinal axis parallel to the sides of the well bore; detonating the explosive charge in the gun; permitting a gas jet to pierce the first layer and outer layer of the gun perpendicular to the longitudinal axis of the gun, well casing and to enter and fracture the strata surrounding the well.

6 Claims, 12 Drawing Sheets

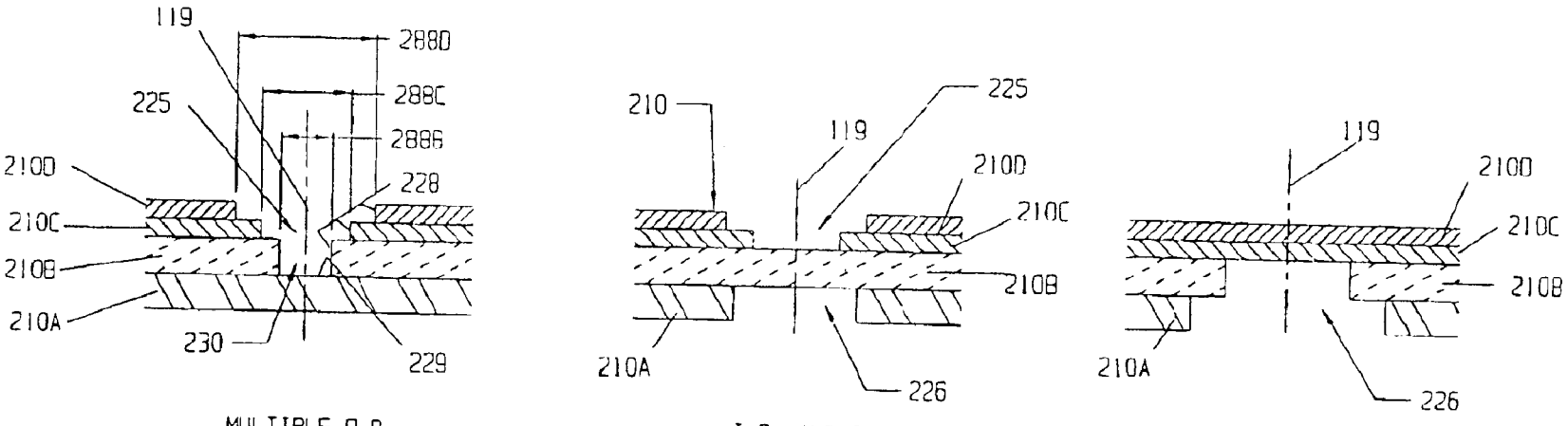
MULTIPLE O.D. RECESSES
FIGURE 11
I.D. AND O.D. RECESSES
FIGURE 12
MULTIPLE I.D. RECESSES
FIGURE 13
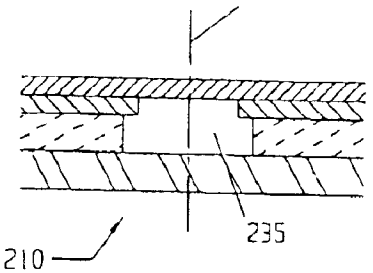
INTERNAL RECESSES
FIGURE 14
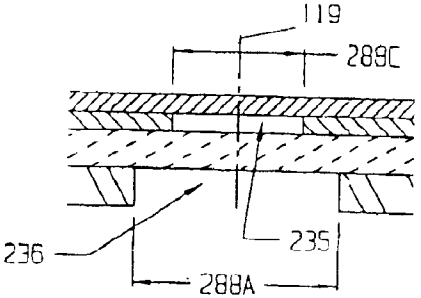
COMBINATION RECESSES
FIGURE 15

METHOD FOR USING A WELL PERFORATING GUN

CROSS REFERENCE TO RELATED APPLICATIONS

This application is a continuation-in-part of application of Ser. No. 10/370,142 filed Feb. 18, 2003, now U.S. Pat. No. 6,865,978 Entitled, "WELL PERFORATING GUN".

BACKGROUND

Typically, the major component of the gun string is the "gun carrier" tube component (herein after called "gun") that houses multiple shaped explosive charges contained in lightweight precut "loading tubes" within the gun. The loading tubes provide axial circumferential orientation of the charges within the gun (and hence within the well bore). The tubes allow the service company to preload charges in the correct geometric configuration, connect the detonation primer cord to the charges, and assemble other necessary hardware. The assembly is then inserted into the gun as shown in FIG. 2. Once the assembly is complete, other sealing connection parts are attached to the gun and the completed gun string is lowered into the well bore by the conveying method chosen.

The gun is lowered to the correct down-hole position within the production zone, and the chares are ignited producing an explosive high-energy jet of very short duration. This explosive jet perforates the gun and well casing while fracturing and penetrating the producing strata outside the casing. After detonation, the expended gun string hardware is extracted form the well or release remotely to fall to the bottom of the well. Oil or gas (hydrocarbon fluids) then enters the casing through the perforations. It will be appreciated that the size and configuration of the explosive charge, and thus the gun string hardware, may vary with the size and composition of the strata, as well as the thickness and interior diameter of the well casing.

Currently, cold-drawn or hot-drawn tubing is used for the gun carrier component and the explosive charges are contained in an inner, lightweight, precut loading tube. The gun is normally constructed from a high-strength alloy metal. The gun is produced by machining connection profiles on the interior circumference of each of the guns ends and "scallops," or recesses, cut along the gun's outer surface to allow protruding extensions or "burrs" created by the explosive discharge through the gun to remain near or below the overall diameter of the gun. This method reduces the chance of burrs inhibiting extraction or dropping the detonated gun. High strength materials are used to construct guns because they must withstand the high energy expended upon detonation. A gun must allow explosions to penetrate the gun body, but not allow the tubing to split or otherwise lose its original shape Extreme distortion of the gun may cause it to jam within the casing. Use of high strength alloys and relatively heavy tube wall thickness has been used to minimize this problem.

Guns are typically used only once. The gun, loading tube, and other associated hardware items are destroyed by the explosive charge. Although effective, guns are relatively expensive. Most of the expense involved in manufacturing guns is the cost of material. These expenses may account for as much as 60% or more of the total cost of the gun. The oil well service industry has continually sought a method or material to reduce the cost while also seeking to minimize the possibility of misdirected explosive discharges or jamming of the expended gun within the well.

Although the need to ensure gun integrity is paramount, efforts have made to use lower cost steel alloys through heat-treating, mechanical working, or increasing wall thickness in lower-strength but less expensive materials. Unfortunately, these efforts have seen only limited success. Currently, all manufacturers of guns are using some variation of high strength, heavy-wall metal tubes.

FIELD OF THE INVENTION

Well completion techniques normally require perforation of the ground formation surrounding the borehole to facilitate the flow if interstitial fluid (including gases) into the hole so that the fluid can be gathered. In boreholes constructed with a casing such as steel, the casing must also be perforated. Perforating the casing and underground structures can be accomplished using high explosive charges. The explosion must be conducted in a controlled manner to produce the desired perforation without destruction or collapse of the well bore.

Hydrocarbon production wells are usually lined with steel casing. The cased well, often many thousands of feet in length, penetrates varying strata of underground geologic formations. Only a few of the strata may contain hydrocarbon fluids. Well completion techniques require the placement of explosive charges within a specified portion of the strata. The charge must perforate the casing wall and shatter the underground formation sufficiently to facilitate the flow of hydrocarbon fluid into the well as shown in FIG. 1. However, the explosive charge must not collapse the well or cause the well casing wall extending into a non-hydrocarbon containing strata to be breached. It will be appreciated by those skilled in the industry that undesired salt water is frequently contained in geologic strata adjacent to a hydrocarbon production zone, there fore requiring accuracy and precision in the penetration of the casing.

The explosive charges are conveyed to the intended region of the well, such as an underground strata containing hydrocarbon, by multi-component perforation gun system ("gun systems," or "gun string"). The gun string is typically conveyed through the cased well bore by means of coiled tubing, wire line, or other devices, depending on the application and service company recommendations. Although the following description of the invention will be described in terms of existing oil and gas well production technology, it will be appreciated that the invention is not limited to those application.

SUMMARY OF THE INVENTION

The invention relates to a method to use a perforating gun for use in oil and natural gas wells having a casing, comprising the steps of: a perforating gun with a loading tube having an explosive charge wherein the gun comprises a first layer slidable, non fixedly, and removeably disposed over the loading tube and at least one outer layer in fixed engagement over the first layer and wherein the outer layer is a solid structure with scallop openings disposed therein and the scallops are positioned in the solid structure in a defined pattern; and wherein the method compromises: suspending the gun with loading tube and explosive charge in a well bore wherein the gun has a longitudinal axis parallel to the sides of the well bore; detonating the explosive charge in the gun; permitting a gas jet to pierce the first layer and outer layer of the gun perpendicular to the longitudinal axis of the gun; permitting the gas jet to pierce the well casing and enter strata surrounding the well and fracturing the strata.

BRIEF DESCRIPTION OF THE DRAWINGS

The accompanying drawings, which are incorporated in and constitute a part of the specification, illustrate preferred embodiments of the invention. These drawings, together with the general description of the invention above and the detailed description of the preferred embodiments below, serve to explain the principals of the invention.

FIG. 11 illustrates multiple outer diameter recesses;

FIG. 12 illustrates inner and outer diameter recesses;

FIG. 13 illustrates multiple inner diameter recesses;

FIG. 14 illustrates internal recesses;

FIG. 15 illustrates combination recesses;

The above general description and the following detailed description are merely illustrates of the subject invention, additional modes, and advantages. The particulars of this invention will be readily suggested to those skilled in the art without departing from the spirit and scope of the invention.

DETAILED DESCRIPTION OF THE INVENTION

The invention disclosed herein incorporates novel engineering criteria into the design and fabrication of well perforating guns. This criterion addresses multiple requirements. First, the gun material's (steel or other metal) ability to withstand high shocks delivered over very short periods of time ("impact strength") created by the simultaneous detonation of multiple explosive charges ("explosive energy pulse" or "pulse") is more important than the material's ultimate strength. This impact strength is measurable and is normally associated with steels with 200 low carbon content and/or higher levels of other alloying elements such as chromium and nickel. Second the shock of the explosion transfers its energy immediately to the outside surface of the tubing. Any imperfections, including scallops, will act as stress risers and can initiate cracking and failure.

The invention relates to a method to use a perforating gun for use in oil and natural gas wells having a casing, comprising the steps of: a perforating gun with a loading tube having an explosive charge wherein the gun comprises a first layer slidable, non fixedly, and removeably disposed over the loading tube and at least one outer layer in fixed engagement over the first layer and wherein the outer layer is a solid structure with scallop openings disposed therein and the scallops are positioned in the solid structure in a defined pattern; and wherein the method compromises: suspending the gun with loading tube and explosive charge in a well bore wherein the gun has a longitudinal axis parallel to the sides of the well bore; detonating the explosive charge in the gun; permitting a gas jet to pierce the first layer and outer layer of the gun perpendicular to the longitudinal axis of the gun; permitting the gas jet to pierce the well casing and enter strata surrounding the well and fracturing the strata.

Figure 1:
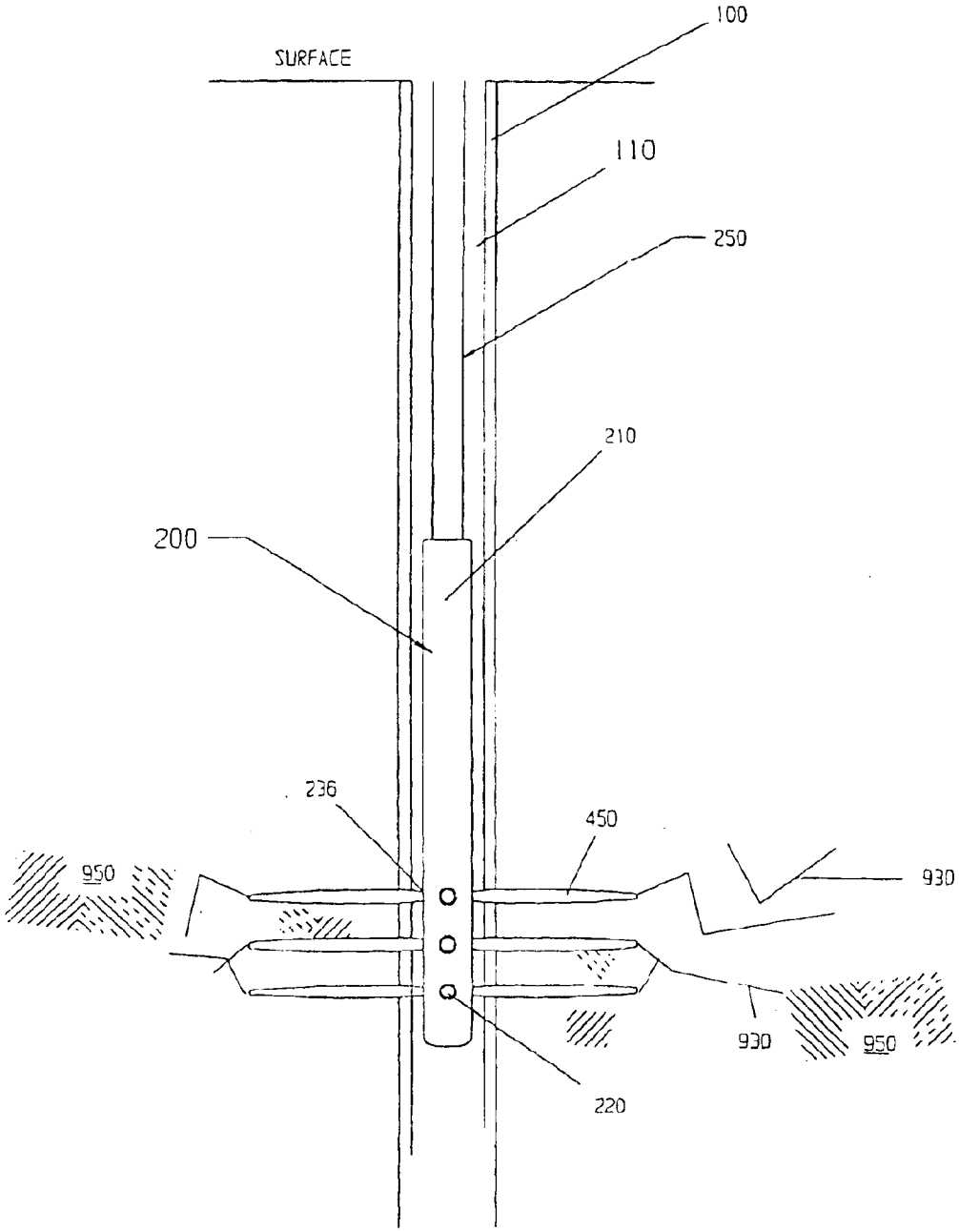
FIG. 1 illustrates the affect of the explosive discharge from a well perforating gun penetrating through the well casing and into the surrounding geologic formation.

FIG. 1 illustrates the basic casing perforation operation in which the tool and fabrication method disclosed in this specification are utilized. The gun 200 is suspended within the well bore 110 by a coil tube or a wire line device 250. The charges (not shown) contained within the gun are oriented in 90 degrees around the circumference of the gun. The explosive gas jet 450 produced by detonation of the charge penetrates 236 through the wall 210 of the gun 200 and well casing 100 creating fractures 930 in the adjacent strata 950. Penetration of the gun wall is intended to occur at machined recesses 220 in the wall 210. The recesses are fabricated in a selected pattern around the circumference of the gun.

It is desirable to use various arrangements or orientations of the charges ("shots") and with varying numbers of charges within a given area ("shot density"). This allows variation in the effect and directionally of the explosive charges. Shots are typically arranged in helical orientation (not shown) around the wall of the gun 200 as well as in straight lines parallel to the axial direction of the gun tube. The arrangements are defined by the application and the design engineers' requirements, but are virtually limitless in variation. Guns are typically produced in increments of 5 feet, with the most common gun being about 20 feet. These guns may hold and fire as many as 21 charges for every foot of gun length. Perforation jobs may require multiple combinations of 20-foot sections, which are joined together end to end by threaded screw-on connectors.

The invention relates to a method to make a perforating gun for use in oil and natural gas wells comprising the steps of: obtaining a length of a first tube; cutting scallop holes into the first tube forming an outer layer; placing the outer layer in a holder; cutting a second tube to the approximate length of the outer layer; pulling the second tube into the outer layer forming a laminate structure having a first and second end; repeating the process for a desired number of layers in the laminate structure; machining internal structures into the laminate structure; inserting the loading tube into the laminate structure; and forming thread protectors in the first end and the second end of the laminate structure.

More specifically, the invention relates to an embodiment wherein the pulling of the second tube into the first tube is accomplished using a gear reduced drive and chain mechanism.

In a preferred embodiment, the method comprises using a length of first tube between 1 foot and 40 feet. A length of second tube is preferably between 1 foot and 40 feet. In still another preferred embodiment, the first and second tubes have an outer diameter ranging between 1.5 inches and 7 inches.

Part of the invention relates to the cutting of the scallops in the outer layer of the invention. This cutting can be performed by either a laser, a drill or a mill. The scallops are preferably cut at a density of at least 1 per foot of scallops.

In pulling the two tubes together, the method contemplates using a holder which is a heavy walled tube that is at least 0.020 larger in diameter than the first tube.

As an additional step, the invention contemplates forming the thread protectors on a lathe prior to insertion on the ends of the laminate.

The inventive device made by this method is described in more detail below.

It will be appreciated that lamination of multiple layer of the same or differing materials may be used to enhance the performance over a single layer of material without increasing thickness. Use of fibrous materials, such as high strength carbon, graphite, silica based fibers and coated fibers are included within the scope of this invention. Although some embodiments may utilize one or more binding elements between one or more layers of material, the invention is not limited to the use of such binders. Plywood is an example of enhancing properties by layering wood to produce a material that is superior to a solid wood board of equal thickness. Applications of multi-layered lamination can be subdivided into primary and complex designs. Additional embodiments of the invention are described below.

Figure 2:
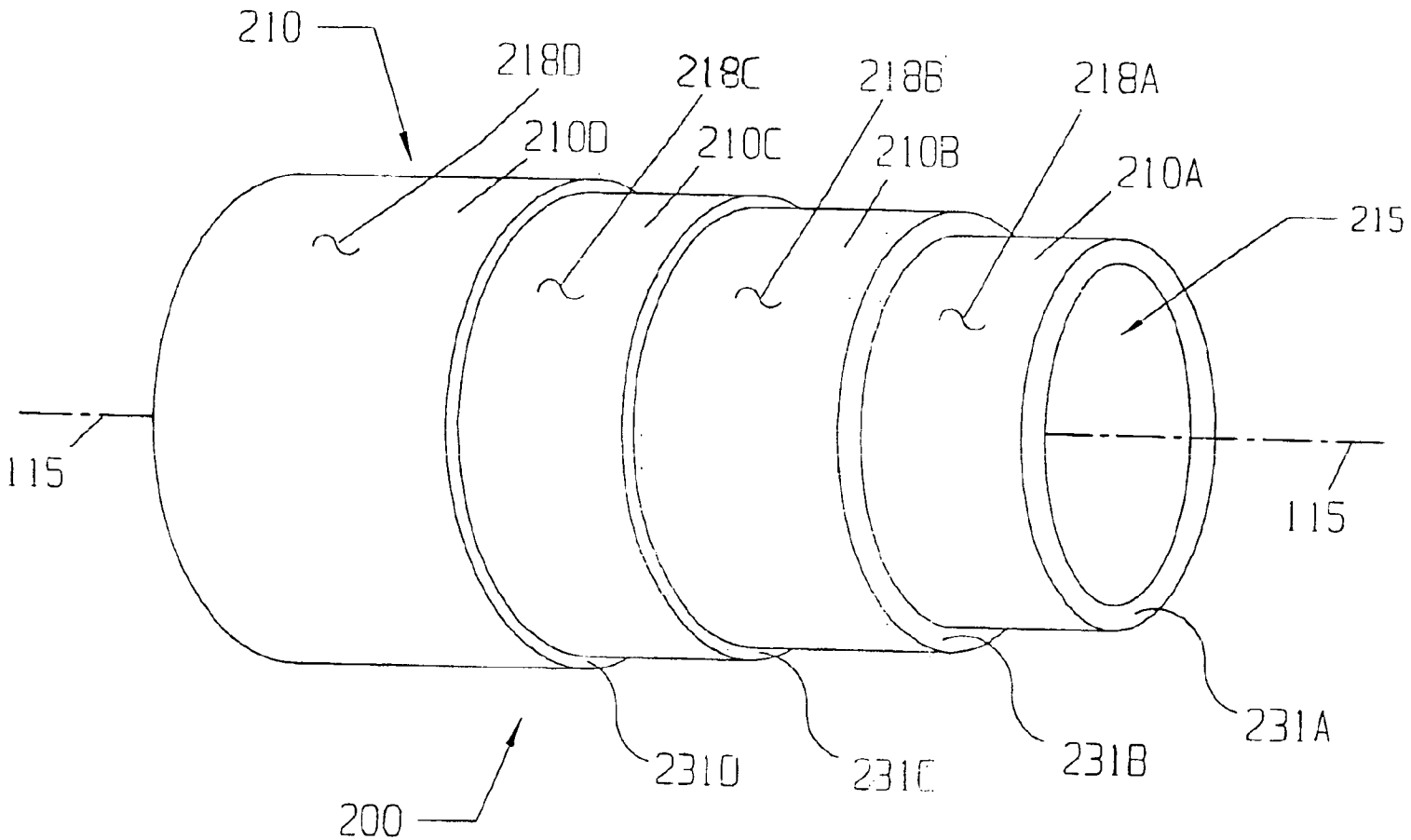
FIG. 2 illustrates an embodiment of the invention comprised of an engineered sequence of layered materials.

FIG. 2 illustrates the construction of a gun wall 210 comprised of four material layers (210A, 210B, 210C and 210D). The orientation of each layer is parallel or at a constant radius to the longitudinal axis 115 of the gun 200 and the well bore (not shown). The thickness of each layer or tube 231D, 231C, 231B and 231A may be varied. The diameter of the annulus 215 formed within the inner tube may also be varied. The outer surface of each respective tube layer may be varied in construction to facilitate binding and retard delamination. Such designs may facilitate the strength characteristics of the gun wall in alternate directions, such as traverse or longitudinal directions. It is known that multi-layered constructions can have numerous advantageous over conventional, monolithic material constructions. It will be appreciated that this invention does not limit the number of layers, the composition of individual layers, or the manner in which layers are assembled or constructed. Further, the invention is not limited to the use of a binder or laminating agent between material layers; for example the outer surface (218A, 218B, 218C, 218D) on the inner most layer 210A and the inner surface of the next out layer.

Figure 3:
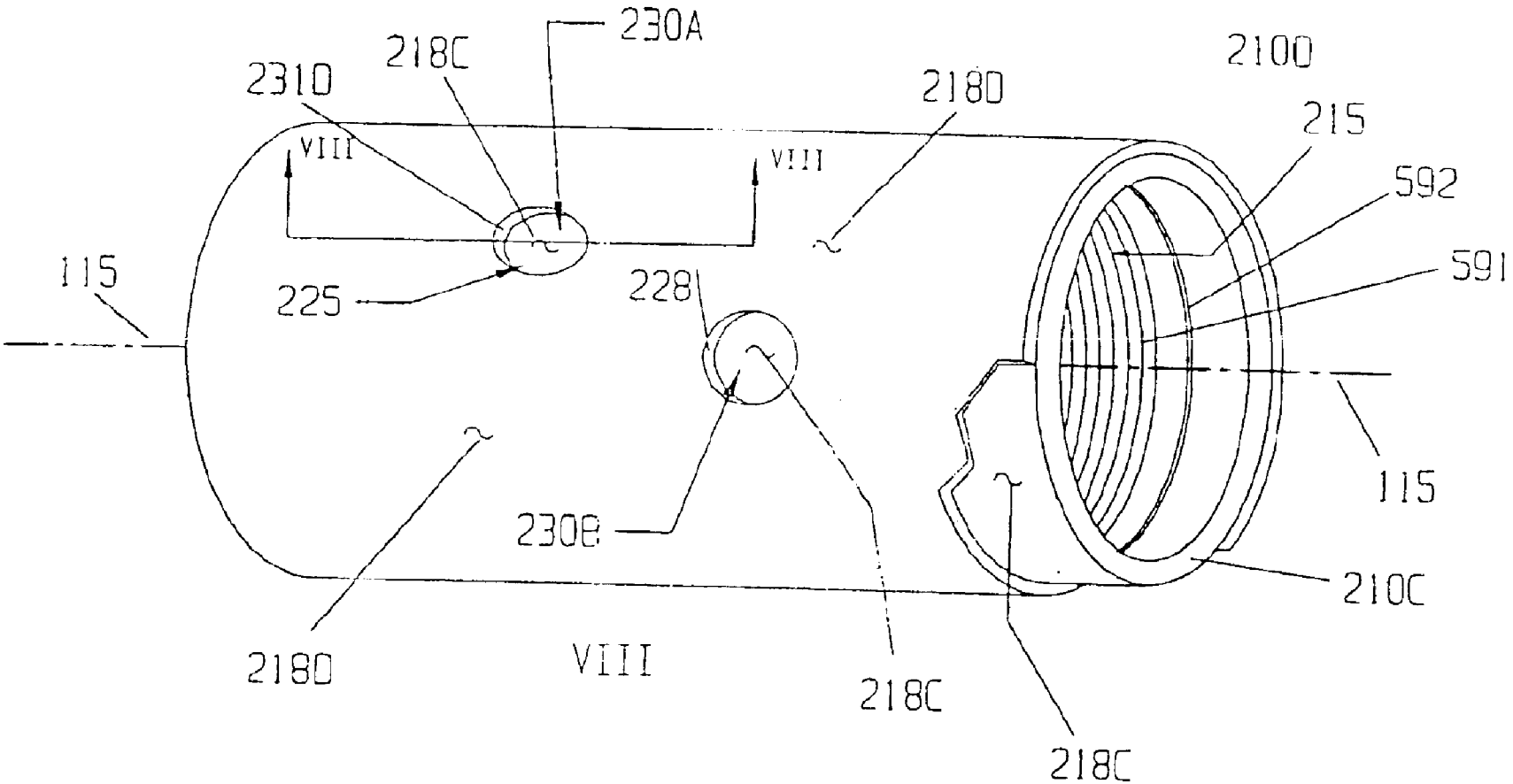
FIG. 3 illustrates an embodiment of the invention comprised of the engineering sequence of layered materials.

FIG. 3 illustrates the primary "tube-within-a-tube" design, similar to the embodiment of the invention illustrated in FIG. 2 and having a longitudinal axis 115. The outer layer 210D is a cylinder or tube in which holes 230A and 230B have been cut through the thickness of the cylinder wall 231D. The diameter of the outer cylinder 210D is approximately equal to the outer diameter of the next inner cylinder 210C. In the embodiment illustrated in FIG. 3, there are no holes cut through the walls of the next inner cylinder 210C. Therefore, the combined cylinder, comprising the "tube-within-a-tube" of 210D and 210C, has the approximate physical shape of the prior art single walled gun having recesses or scallops machined into the outer surface of the wall. In a preferred embodiment of the invention, holes 230A and 230B are cut through the outer cylinder wall 210D prior to assembly of the two cylinders 210C and 210D. A side wall 228 is shown. A recess 225 is also shown. The outer surface 218C and 218D is shown. The line VIII—VIII designates the location of the cross sectional view illustrated in FIG. 3.

FIG. 3 illustrates a design that incorporates a machined connection end components 591 and 592 on the innermost tube 210C of a multilayered tube construction.

Figure 4:
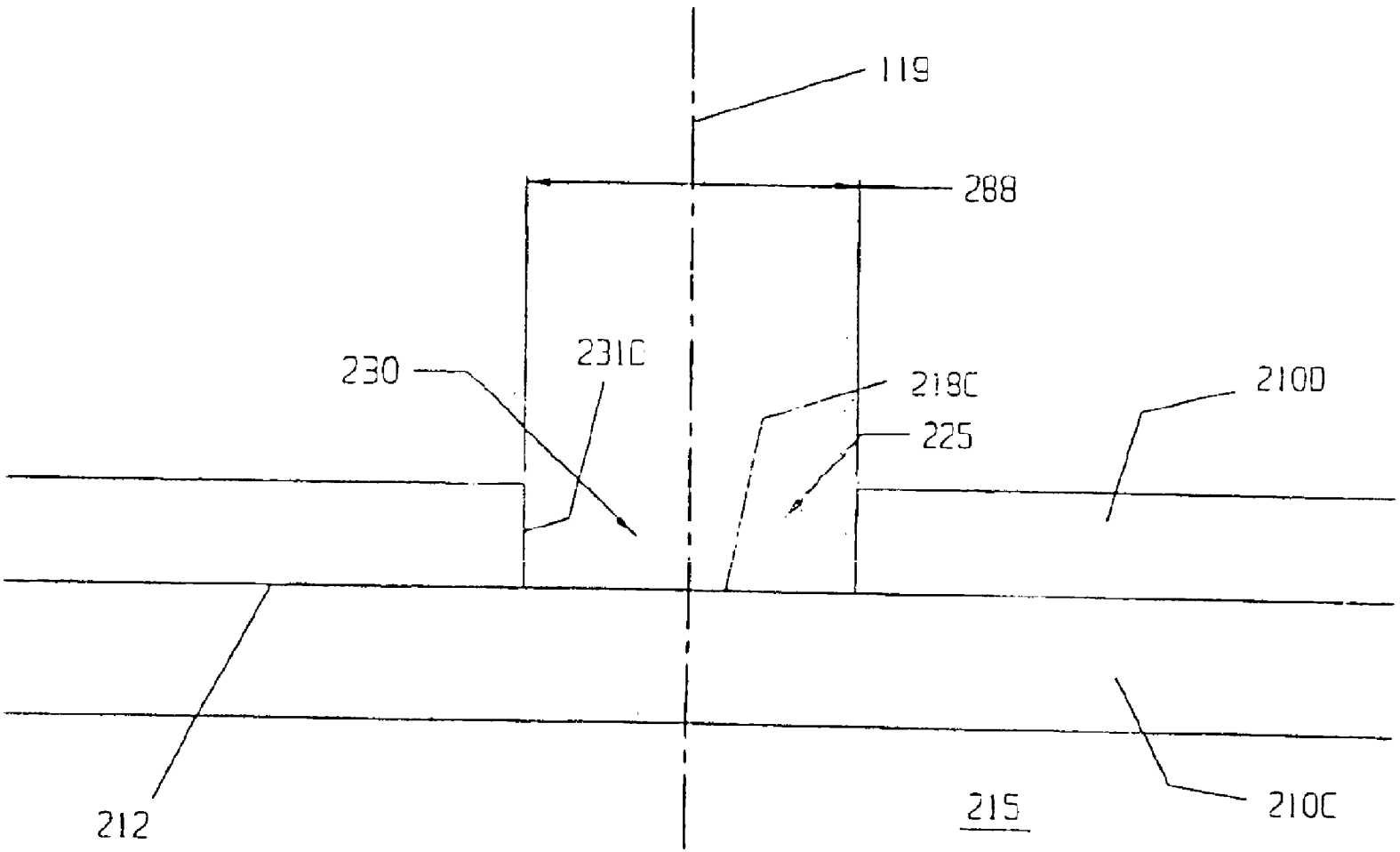
FIG. 4 depicts a cross section of two layers.

FIG. 4 shows a portion of the inner cylinder wall 210C and its relationship with the outer wall 210D and annulus 215. The illustration does not; however depict the radial curvature of each layer. The diameter of the hole 288 may be varied. The axis 119 of the resulting hole 230 may be orthogonal to the longitudinal axis (115 of FIG. 3).

In the structure of the invention shown in FIG. 4, the thickness 231D of outer cylinder wall 230D forms the side wall (228 in FIG. 8) of the recess 225. The outer surface 218C of the next inner cylinder 230C forms the bottom (229 in FIG. 3) of the recess or scallop 225.

It will be readily appreciated that the composition of the several layers or cylinders might differ. Also the thickness and number of layers might be varied, depending upon the requirements of the specific application. The cutting of holes can be accomplished before assembly, thereby eliminating the need for machining.

FIG. 4 also illustrates the ability to perform machining or other fabrication on the individual cylinder components prior to assembly into the completed unit. For example, machining of connector structures can be performed on the inner cylinders individually prior to being inserted or pulled into the larger cylinders. These structural components may be machined threads, seal bores, etc.

As discussed above, it is not necessary that the interface 212 of the surfaces of the inner and outer tubes or cylinders be bound or otherwise mechanically attached together. An advantage to this design is its simplicity and ease of manufacture. Each of the tubes may have different chemical and mechanical characteristics, depending on the performance needs of the perforation work. Alternatively, each tube can be made of the same material. In another variation, layers of tubing can be made of the same material but oriented differently to achieve the desired properties (similar to the mutually orthogonal layering of plywood). One further variation can b implemented by offsetting a seam of each cylinder or tube layer created in the manufacturing process by rolling flat material into a tube.

One variation of the embodiment illustration in FIG. 3 might include an inner tube of high-strength material (such as the high-strength, alloy metals currently used for guns) and an outer tube of mild steel.

Figure 5:
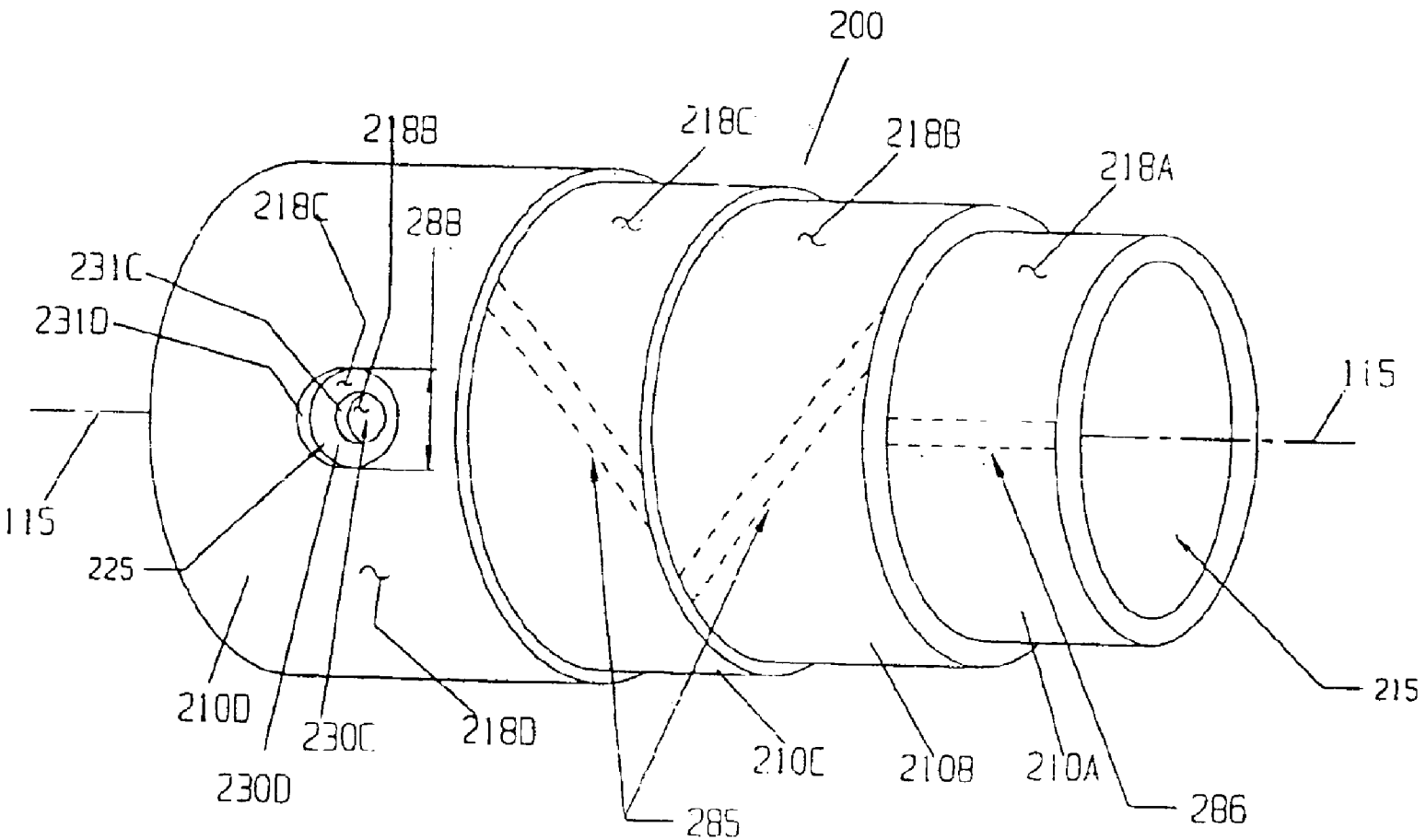
FIG. 5 illustrates a cross section view of the layered wall construction.
Figure 9:
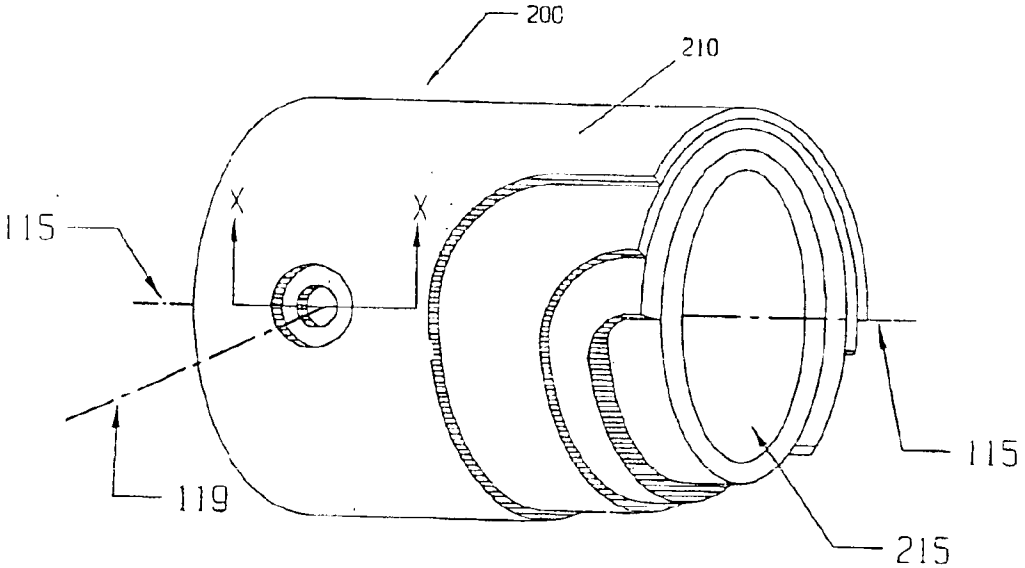
FIG. 9 illustrates an embodiment of the invention utilizing solid layers.

FIG. 5 illustrates an embodiment of the invention in which the gun has four material layers (210D, 210C, 210B and 210A) each with an outer surface (210D, 210C, 210B, 210A). The invention, however, is not limited to four layers. The multilayer design might consist of "tube-within-a-tube" fabrication or the wrapping of material around the outer surface of an inner tube maintaining a relative uniform radius about a central axis 115. The inner tube defines the area of the tube annulus 215. The tubing layers may be seamless or rolled. It will be readily appreciated that layering material can be wrapped in various orientations 285 and 286 to provide enhanced strength. Two layers 210C and 210B are shown helically wrapped 285 at a radius around the longitudinal axis 115. The next inner layer 210A is shown comprised a rolled tube having a seam parallel to the longitudinal axis. It will also be appreciated that the wrapping might include braiding or similar woven construction of material. FIG. 9 also illustrates that any given layer 210C and 210B might consist of a material "tape" wrapped around an inner tube or cylinder 210A. The inner most layer 210A with an outer surface 218A may also be formed around a removable mandrel. The laminations can consist of other metals or non-metals to obtain desirable characteristics. For example, aluminum is a good energy absorber, as is magnesium or lead. This invention does not limit the material choices for the lamination layers or the manufacturing method in obtaining a layer; it specifies of that layers exist and provide advantages over single-wall, monolithic gun designs.

Also illustrated in FIG. 5 are one or more layers 210D and 210C containing holes 230D and 230C having diameters cut prior to assembly. The hole 230D cut into the outer tube 210D has a diameter 288. The axis of the holes can be orthogonal to the longitudinal axis 115 of the gun 200. The tube layer thickness 231D and 231C forms the wall of the recess 225 and the outer surface 218B of the next underlying layer 210B forms the bottom of the recess 225. The architecture of the resulting recess is comparable, but advantageous to, the prior art machined scallops.

Wrapping designs and fabrication techniques allow far greater numbers of metals and non-metallic materials to be used as lamination layers, thereby achieving cost savings and reducing production and fabrication times. Improved rupture protection can be achieved without increasing the weight or cost.

Figure 6:
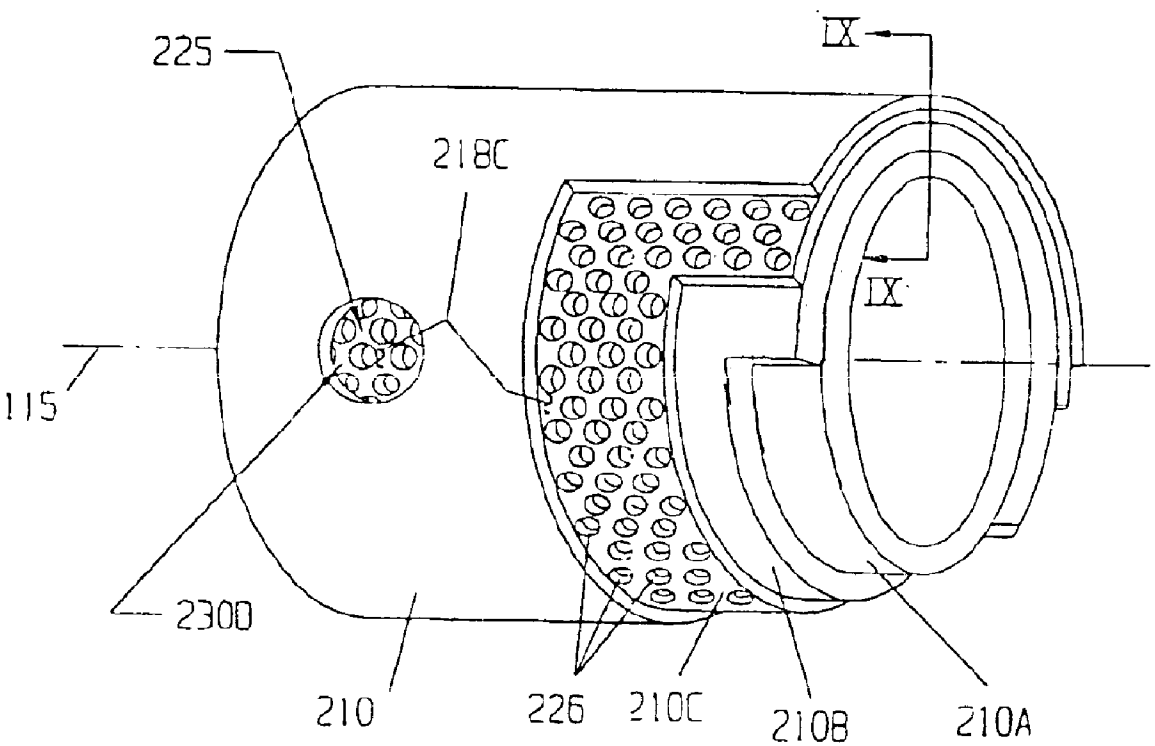
FIG. 6 illustrates an embodiment of the invention utilizing precut holes and wrapped layers.

FIG. 6 illustrates how a perforated or non-continuous material can produce a lamination layer, even though voids may exist within that layer. The layers might consist of continuous sheets with regular perforations, woven sheets of wire, bonded composites, etc. An energy absorption layer 210C contains numerous perforations 226 each having small diameter 289. In another embodiment, not shown, the voids might contain material contributing to material strength at ambient temperature and pressure, but that is readily vaporized by the explosive high-temperature and high-pressure energy pulse, thereby providing minimal energy impedance proximate to the explosive charge, recess and well casing, but maximum shock absorption in other portions of the gun not immediately subjected to the directed high temperature explosive gas jets.

The energy absorption layer 210C illustrated in FIG. 6 has mechanical properties permitting the inner layers 210B and 210A to expand into the volume occupied by the absorption layer in response to the high impact outward traveling explosive energy pulse occurring upon charge detonation. This mechanical action will consume energy that might otherwise contribute to a catastrophic failure of the outer layer 210D. As already discussed, such failure can hinder the intended perforation of the well casing and the surrounding geologic formation (not shown) or hinder the removal of the gun from the well. These mechanical property enhancements allow higher strength, thinner wall perforating guns with high impact resistance and energy absorption.

In addition to the specific energy absorbing layer shown in FIG. 6, it will be appreciated that each layer could provide strength or other properties specifically selected by the design engineer to meet conditions of an individual well bore. Therefore, this invention allows wall thickness and composition to become design variables without needing mill runs or large quantities of material.

FIG. 6 also illustrates a recess 225 in the gun wall 210 fabricated from hole 230D cut through selected layers 210D prior to assembly of the combined tubes. The outer surface 218C forms the bottom of the precut recess 230D.

Figure 7:
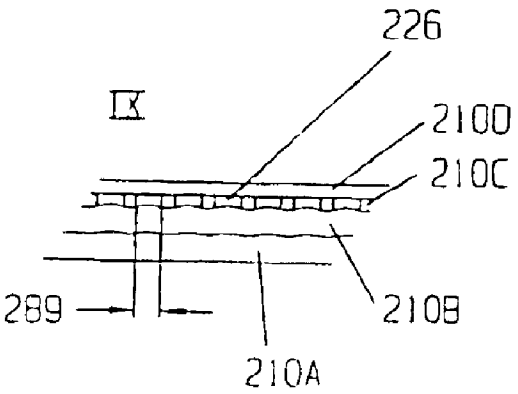
FIG. 7 illustrates a cross section of an embodiment of the invention utilizing precut holes and wrapped layers.

FIG. 7 also illustrates a cross section of area IX depicted on FIG. 6. An energy absorption layer 210C can contain numerous perforations 226 each having small diameter 289. The inner layer 210A and 210B are shown, as well as outer layer 210D.

Figure 8:
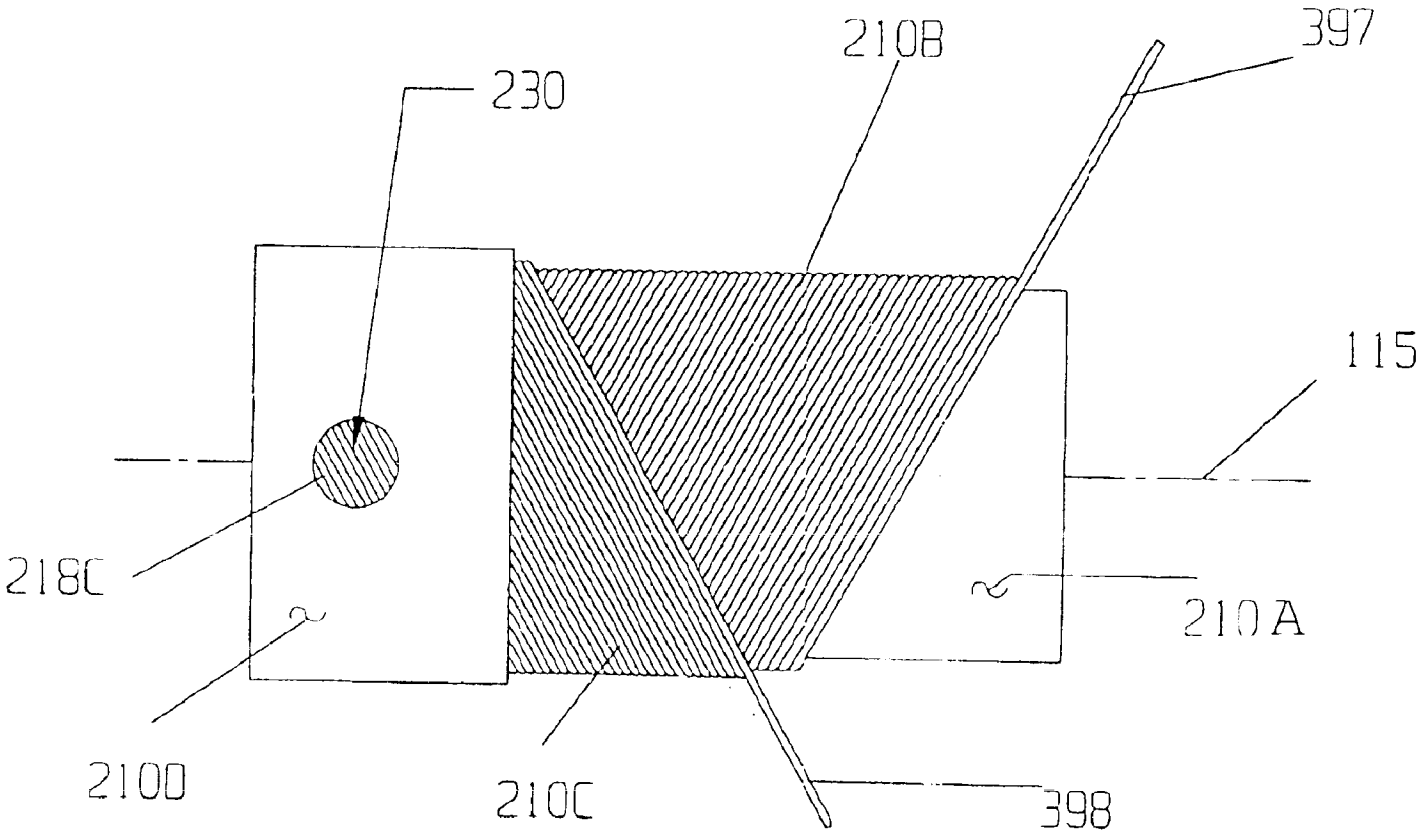
FIG. 8 illustrates an embodiment of the invention utilizing wire wrapped layers.

FIG. 8 illustrates an embodiment using helically wound fiber or wire 397 and 398 around an inner layer 210A. The wrapping can also be performed utilizing a removable mandrel. The wrapped layers 210B and 210C can be combined with tubes or cylindrical layers 210A and 210D. The tube layers can incorporate precut hole 230 in the outer layer 210D. The outer surface 218C forms the bottom of the precut recess 230. The winding may be performed prior to placement of the next outer layer. The fiber or wire can be high strength, high modulus material. This material can provide strength against the explosive pulse. The diameter of fiber or thickness of wrapping can be varied for specific job requirements. The geometry of the winding (or braiding) can be varied, particularly in regard to the orientation to the longitudinal axis 115.

FIG. 9 illustrates a complex gun 200 formed from multiple layers or tubes radially aligned around a longitudinal axis 115. The wall 210 of the gun 200 forms a housing around an annulus 215. The explosive charges, detonator cord, and carrier tube can be placed within this annulus 215. Also illustrated is a recess 225 formed in the manner described previously.

Figure 10:
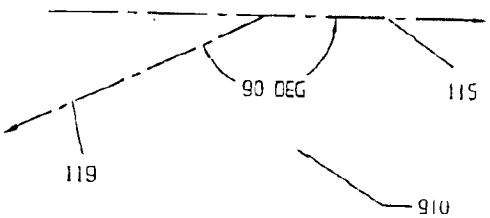
FIG. 10 illustrates the proper angle.

FIG. 10 depicts the center axis 119 of the illustrated recess 225 is orthogonally oriented 910 to center axis of the gun 115.

FIG. 11 illustrates an embodiment of the invention wherein the outer three layers 210D, 210C and 210B of the gun wall 210 contain holes cut prior to assembly of the tubes into a single cylinder. Although the diameter 288D, 288C and 288B of each hole is different, the center axis 119 of the combined holes 230 are aligned. The inner layer 210A is not cut, and the outer surface 218A of that tube forms the bottom 229 of the resulting recess 225. The thickness of each precut layer creates a stepped wall 228 of the recess.

FIG. 12 illustrates another embodiment wherein the inner tube layer 210A is cut through prior to assembly, a next outer layer 210B is not cut at the location, but the next outermost layers 210C and 210D are cut through and the center axis of the precut holes are aligned 119. This architecture achieves an inner recess 226 within the gun wall 210 aligned with an outer recess 225. This architecture or structure can be readily achieved by this invention. This structure cannot be practically achieved by the prior technology.

FIG. 13 illustrates another embodiment wherein the inner tube layer 210A is cut through prior to assembly, a next outer layer 210B is not cut at the location, but the next outermost layer 210C and 210D are cut through and the center axis of the precut holes are aligned 119. It will be appreciated that the shape of the interior recess 226 can be varied in the same manner as the outer recesses may be formed.

FIG. 14 illustrates a structure that has not been possible prior to the invention. The gun wall 210 can contain an interior recess or cavity 235. The radial axis 119 of the cavity can be aligned with an explosive charge. At the time of assembly, the cavity may be filled with a eutectic material or other material selected to provide strength at ambient conditions but disperse, vaporize or otherwise degrade with the rapid explosive energy pulse.

FIG. 15 illustrates a combination interior recess 236 with an internal cavity 235. The interior recess diameter 288A and the internal cavity diameter 288C may be varied as selected by the gun designer.

It will be readily appreciated that the dimensions of each precut hole can be specified. This ability can achieve recesses within multiple layers that, when assembled into the composite gun, the recess walls may possess a desired geometry that may enhance the efficiency of the explosive charge or otherwise impact the directionality of the charge. Further, it will be appreciated that interior recesses may be filled with materials that, when subjected to high temperature, rapidly vaporize or undergo a chemical reaction enhancing o contributing to the original energy pulse.

Figure 16:
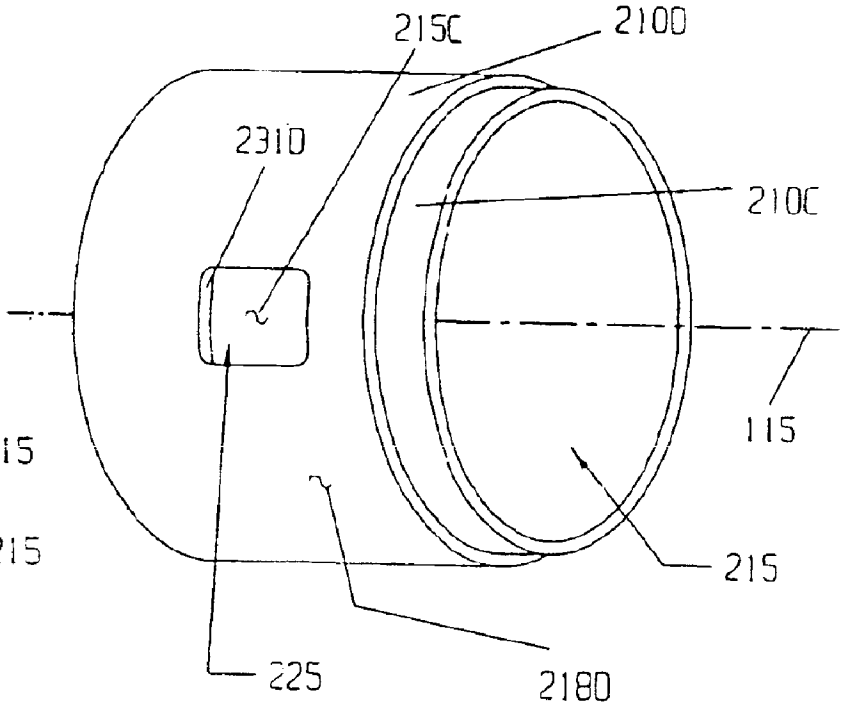
FIG. 16 demonstrates scallop configurations with a multi-layered perforation device usable in the method of the invention.

FIG. 16 illustrates precut holes forming recesses 225 in the outer layer 210D of the multi-layered gun wall 210D and 210C, having predefined complex outside wall shapes alternative to the circular shaped precut hole. The layer thickness 231D and surface 218D and 218C as well as the annulus 215 and longitudinal axis 115 are also shown. Actual shape design is unlimited since design is no longer restricted by conventional machining methods. Any combination between layers and any shape can be easily produced by laser cutting, tube assembly or layer lamination, and any required material wrapping.

Figure 17:
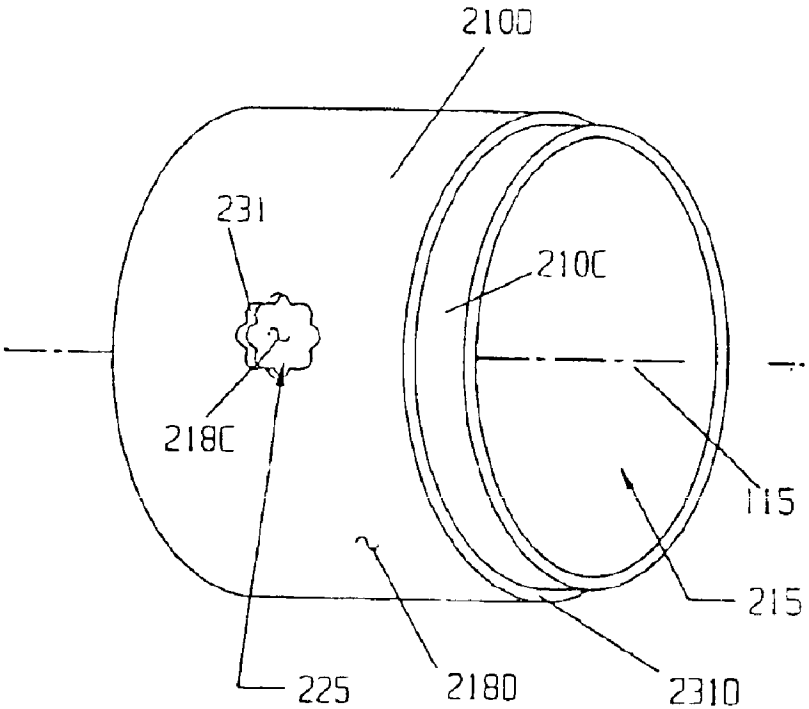
FIG. 17 demonstrates scallop configurations with a multi-layered perforation device usable in the method of the invention.

FIG. 17 shows that different scallop shapes 225 can be used in the method of the invention.

Figure 18:
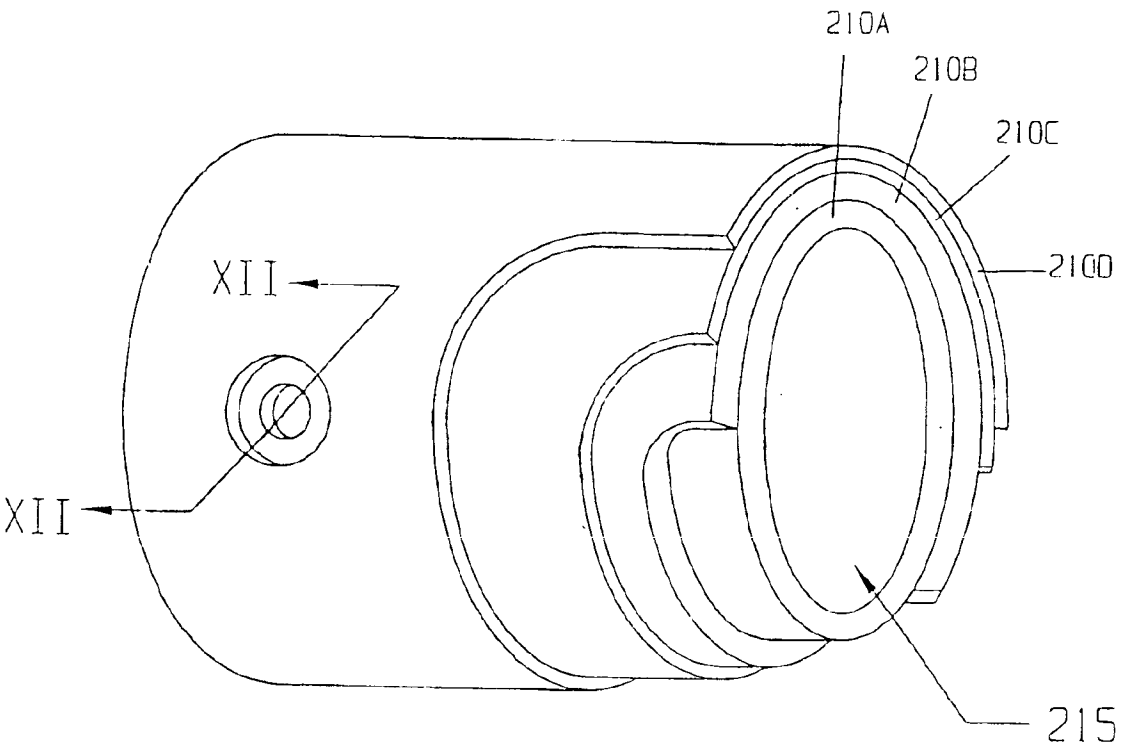
FIG. 18 depicts the layer of the invention.

FIG. 18 depicts an annulus 215, with the outer layer (210A 210B, 210C, 210C, 210D) surrounding the annulus 215.

An additional advantage of the invention is fewer "off-center" shot problems and better charge performance due to scallop wall orientation since the outer tube's recess can achieve a constant underlying wall thickness regardless of the explosive jet exit point. It will be appreciated that if the explosive pulse of the detonated charge is not oriented perpendicular to the outside gun wall, the brief explosive jet pulse will encounter a non uniform gun wall, thereby creating a disruption or turbulence in the flow with resulting dissipation of energy. The invention subject of this disclosure results in a uniform wall thickness, thereby minimizing energy dissipation.

Figure 19:
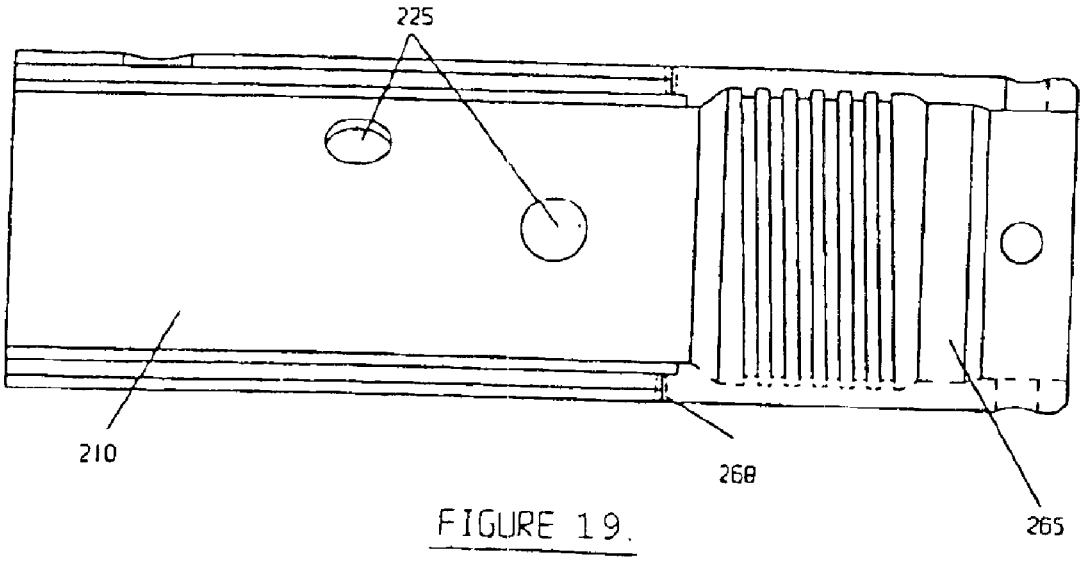
FIG. 19 depicts further attachment of end fittings to perforating guns subject of the invention with helically disposed scallops on the outer layer.

FIG. 19 illustrates a weld seam 268 connecting components 265 to multiple layers of gun wall 210 requiring less machining. This weld can be performed by laser welding, similar to techniques available for precutting of holes 225 within the gun wall 210.

Figure 20:
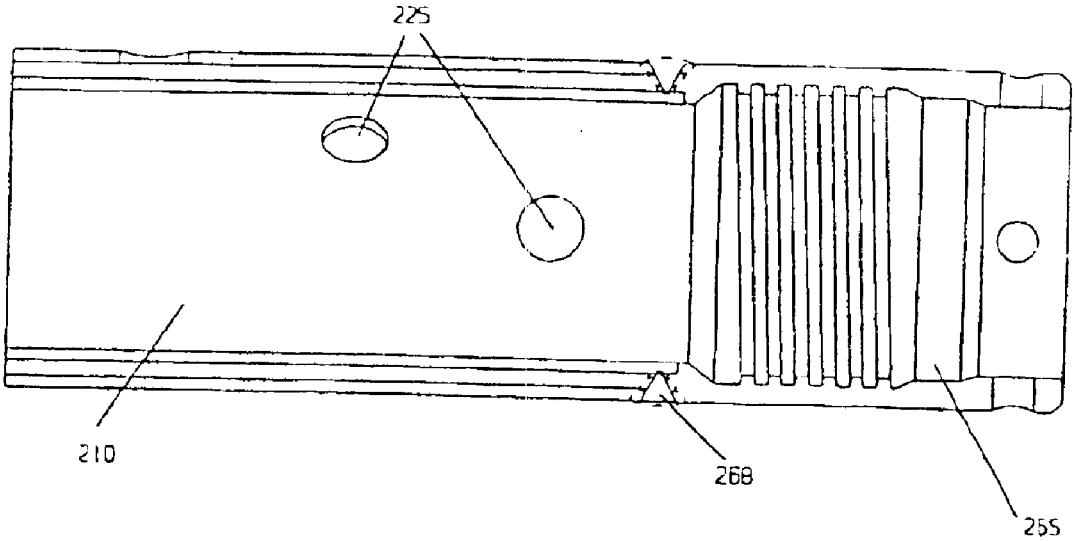
FIG. 20 depicts further attachment of end fittings to perforating guns subject of the invention with helically disposed scallops on the outer layer.

FIG. 20 depicts the size weld seam 268 achieved by conventional well technology. A weld seam 268 connects components 265 to multiple layers of gun wall 210 requiring less machining. This weld can be performed by laser welding, similar to techniques available for precutting of holes 225 within the gun wall 210.

In some embodiments, it may be advantageous to weld or mechanically attach machine threaded connection ends to at least one tube layer. FIG. 19 and FIG. 20 illustrate the use of laser welding gun connection fittings for designs utilizing multiple layers. Laser welding involves low-heat input process, thereby allowing completed machined connection end turnings to be welded directly. Conventional multi-pass welds may require machining after welding to eliminate the effects of distortion.

Other advantages of the invention include more choices of tube supply, especially domestic supplies with far shorter lead times. Lower manufacturing costs are achieved by laser cutting scallops in the outer lamination instead of machining solid, heavy-walled tubes, which is the practice of current technology.

Specific benefits from the construction of guns utilizing multi-layering of differing materials and material costs, reduction of material weight and thickness, decreased dependence upon expensive high strength materials having long lead-time production requirements, and greater flexibility in gun designs including tailoring the properties of the gun wall to accommodate varying field conditions to achieve enhanced performance. In addition, better gun performance is achieved by precut tube scallops having uniform thickness, increased flexibility to create modified scallop walls and shapes, and increased impulse shock absorption by the multiple tube layer interface. Also an inner tube can have higher strength without the adverse effects of brittleness since an outer ductile layer may contain the inner tube.

Since recesses (scallops) can be cut individually into each tube layer before being assembled into a gun tube, many different recess designs are available. One benefit of this recess capability is to produce internal and inner diameter (inner wall) recesses that would be virtually impossible to produce in conventional gun manufacture. It is not the intent of this invention to specifically describe the benefits of all recess designs, but rather to indicate that the advantages will be apparent to persons skilled in the technology of this invention.

It will be appreciated that other medications or variations may be made to the invention disclosed herein without departing from the scope of this invention.

What is claimed is:

1. A method to use a perforating gun for use in oil and natural gas wells having a casing, comprising the steps of:

a. loading a perforating gun with a loading tube having an explosive charge wherein the perforating gun comprises a first layer slidable, non fixedly, and removeably disposed over the loading tube and at least one outer layer in fixed engagement over the first layer forming a laminate with a first end and a second end; and wherein said outer layer is a solid structure with scallop openings disposed therein and said scallops are positioned in the solid structure in a defined pattern;

b. suspending the loaded perforating gun in a well bore with a well casing;

c. detonating the explosive charge in the gun;

d. permitting a gas jet to pierce the first layer and outer layer of the gun;

e. permitting the gas jet to further pierce the well casing and enter strata surrounding the well bore; and f. fracturing the strata.

2. The method of claim 1, wherein the gun has a longitudinal axis parallel to the sides of the well bore.

3. The method of claim 1, further comprising the step after detonation of the gun, extracting the gun from the well bore, cutting off the first and second ends to be reused on another gun, and recycling the remainder of the gun.

4. A method to use a perforating gun for use in oil and natural gas wells having a casing, comprising the steps of:

a. loading a perforating gun with a loading tube having an explosive charge wherein the perforating gun comprises: a first layer slidable, non fixedly and removeably disposed over the loading tube and at least one outer wire layer wound over the first layer;

b. suspending the loaded perforating gun in a well bore with a well casing;

c. detonating the explosive charge in the gun;

d. permitting a gas jet to pierce the first layer and outer layer of the gun;

e. permitting the gas jet to further pierce the well casing and enter strata surrounding the well bore; and f. fracturing the strata.

5. The method of claim 4, wherein the gun has a longitudinal axis parallel to the sides of the well bore.

6. The method of claim 4, further comprising the step after detonation of the gun, extracting the gun from the well bore, cutting off the first and second ends to be reused on another gun, and recycling the remainder of the gun.

* * * * *